US008858405B2

(12) United States Patent
Agate

(10) Patent No.: US 8,858,405 B2
(45) Date of Patent: Oct. 14, 2014

(54) MULTIPLY-ADAPTABLE PHYSICAL TRAINING SYSTEM

(71) Applicant: Andre Agate, Toronto (CA)

(72) Inventor: Andre Agate, Toronto (CA)

( * ) Notice: Subject to any disclaimer, the term of this patent is extended or adjusted under 35 U.S.C. 154(b) by 0 days.

(21) Appl. No.: 13/691,972

(22) Filed: Dec. 3, 2012

(65) Prior Publication Data

US 2013/0095984 A1 Apr. 18, 2013

Related U.S. Application Data

(63) Continuation of application No. PCT/CA2011/050332, filed on Jun. 1, 2011.

(60) Provisional application No. 61/350,317, filed on Jun. 1, 2010.

(51) Int. Cl.

| | |
|---|---|
| ***A63B 21/072*** | (2006.01) |
| ***A63B 21/075*** | (2006.01) |
| ***A63B 21/00*** | (2006.01) |
| ***A63B 21/06*** | (2006.01) |
| ***A63B 23/04*** | (2006.01) |
| *A63B 69/34* | (2006.01) |

(52) U.S. Cl.

CPC ..... *A63B 21/00043* (2013.01); *A63B 21/0613* (2013.01); *A63B 23/047* (2013.01); *A63B 2021/0616* (2013.01); *A63B 21/0618* (2013.01); *A63B 69/345* (2013.01)

USPC ..... 482/106; 482/74; 482/93

(58) Field of Classification Search

USPC ..... 482/66–68, 74, 93, 106, 92, 110, 114; 473/441, 445; 280/47.31

See application file for complete search history.

(56) References Cited

U.S. PATENT DOCUMENTS

| | | | | |
|---|---|---|---|---|
| 2,973,203 | A | 10/1961 | Taylor | |
| 4,641,836 | A | 2/1987 | Clifton | |
| 5,632,707 | A | 5/1997 | Daniel | |
| D398,431 | S | 9/1998 | McDonald | |
| 5,810,697 | A | 9/1998 | Joiner | |
| 6,942,585 | B1 * | 9/2005 | Krause | 473/445 |
| D606,611 | S | 12/2009 | Rogers et al. | |
| 7,727,089 | B2 | 6/2010 | Gilman | |
| 2007/0158922 | A1 * | 7/2007 | Mullen et al. | 280/47.31 |
| 2007/0290460 | A1 * | 12/2007 | Girard et al. | 280/1.5 |
| 2009/0179393 | A1 * | 7/2009 | Ludlow | 280/47.31 |
| 2011/0124474 | A1 * | 5/2011 | Gilman | 482/93 |
| 2011/0224050 | A1 * | 9/2011 | Larish | 482/93 |

OTHER PUBLICATIONS

International Search Report issued on PCT/CA2011/050332 on Sep. 6, 2011.

* cited by examiner

*Primary Examiner* — Loan H Thanh
*Assistant Examiner* — Nyca T Nguyen
(74) *Attorney, Agent, or Firm* — Shahrzad Esmaili; Blake, Cassels & Graydon LLP

(57) ABSTRACT

An exercise device includes a frame with a pair of longitudinal support rails arranged side by side in a spaced apart arrangement, a connector for connecting the rails and a first end adapted to accept a wheel. The frame is bent at its first end such that when the frame is laid level on a surface, the wheel is not in contact with the surface upon which the frame lies and when the second end of the frame is raised, the wheel engages the surface. The frame also has one or more weight support members for receiving weights such as weight plates.

8 Claims, 5 Drawing Sheets

MULTIPLY-ADAPTABLE PHYSICAL TRAINING SYSTEM

CROSS REFERENCE TO RELATED APPLICATIONS

This application is a Continuation of PCT Application number PCT/CA2011/050332, filed on Jun. 1, 2011, which claims priority under the Paris Convention to U.S. Application No. 61/350,317, filed on Jun. 1, 2010. The entire disclosures of such prior applications are incorporated herein by reference.

FIELD OF THE INVENTION

The present invention relates generally to physical training devices, and more particularly to a physical training device adaptable to be used for several types of exercise, particularly strength training exercise for various groups of muscles. The present invention is particularly suited for, although not limited to, use in physical training techniques involving gluteal muscles, virtually all leg muscles, biceps, triceps and core muscles when employed in various configurations.

BACKGROUND OF THE INVENTION

Resistance training devices and free weights are well known for the beneficial results in physical and weight training, and are found in many gymnasia and even in private homes. It is also well accepted that using a variety of exercise devices can assist in maintaining the interest of the user and in addition can provide alternate ways of using various muscle groups and enhance the balance between the capabilities of the various muscle groups.

Sleds operated either by pushing or by dragging through the use of a harness slide readily across soft surfaces such as carpets and grassy areas, but do not perform well on hard surfaces such as wood and concrete floors and may even cause significant damage to either the sled or the underlying surface.

Devices equipped with one or more wheels roll readily across many surfaces and, like sleds, can be fitted with a user-selected range of weights to provide the desired exercise level. Indeed, the common wheelbarrow is a form of such device, although it is rarely used purely for exercise purposes.

However, presently known exercise devices are not highly adaptable as they are not readily capable of operating alternatively with wheels, as a lifting device or as a sled.

SUMMARY OF THE INVENTION

In one aspect, described herein is an exercise device comprising a frame with two longitudinal support rails arranged side by side in a spaced apart arrangement. The support rails are connected to each other by a connection means. The frame has a first end and a second end, the first end adapted to accept a wheel. The frame is bent proximally to its first end such that when the frame is laid level on a surface, the wheel is not in contact with the surface upon which the frame lies and when the second end of the frame is raised, the wheel engages the surface. The frame also has a weight support member positioned between the first end and second end of the frame.

According to one aspect, the present invention overcomes the above-mentioned disadvantages and meets the need for a variety of exercise positions in a single device by providing an exercise device comprising a frame having two spaced-apart sled rails having matching upward proximal obtuse-angle bends at a proximal end of the frame, the proximal end of each rail accepting a wheel to be mounted for fore-and-aft motion with respect to the frame, the wheel being mounted at a position such that when the frame lies flat on a surface the wheel is raised off the surface and when the distal end of the frame is raised, the wheel engages the surface and bears a portion of the weight of the exercise device, the frame having a first weight mounting point positioned on the flat section of the sled rails adjacent the bend, the weight mounting point comprising at least one horizontal support member joining the rails and fixing the rails apart, and a substantially vertical rod fixed on and protruding upwards from the horizontal member, and adapted to accept a plurality of stackable weights, and an accessory mounting point at the distal end of each sled rail removably accepting an accessory from the group consisting of a push bar and a pair of lifter handles, the accessory having a rail mounting portion engaging each rail to provide a substantially rigid mounting, and a demountable fixing device to fix the accessory removably to the distal end of the rail.

The exercise device optionally includes a removable pair of lifter handles, each handle being adapted to be removably fixed to the handle ends of each handle mounting arm for lifting the exercise device in the manner of a wheelbarrow. Each lifter handle comprises a secondary weight stacking member which is a rod fixed on the handle mounting element on each lifter handle, and protruding at a substantially right angle to the axis of the rail and at a left-right angle with respect to the ground from zero to about 90 degrees from the vertical, the secondary weight stacking rod being adapted to accept a plurality of stackable weights having a central hole. The exercise device can also be pushed in the manner of a sled, and for this purpose a removable push bar is optionally provided, which is adapted to the removably affixed to the distal ends of and to join the two handle mounting arms. Tow brackets are also optionally provided on the frame to enable towing exercises.

BRIEF DESCRIPTION OF THE DRAWINGS

In drawings illustrating embodiments of the invention, in which like numbers identify like parts in the several drawings.

DETAILED DESCRIPTION OF THE INVENTION

Figure 1:
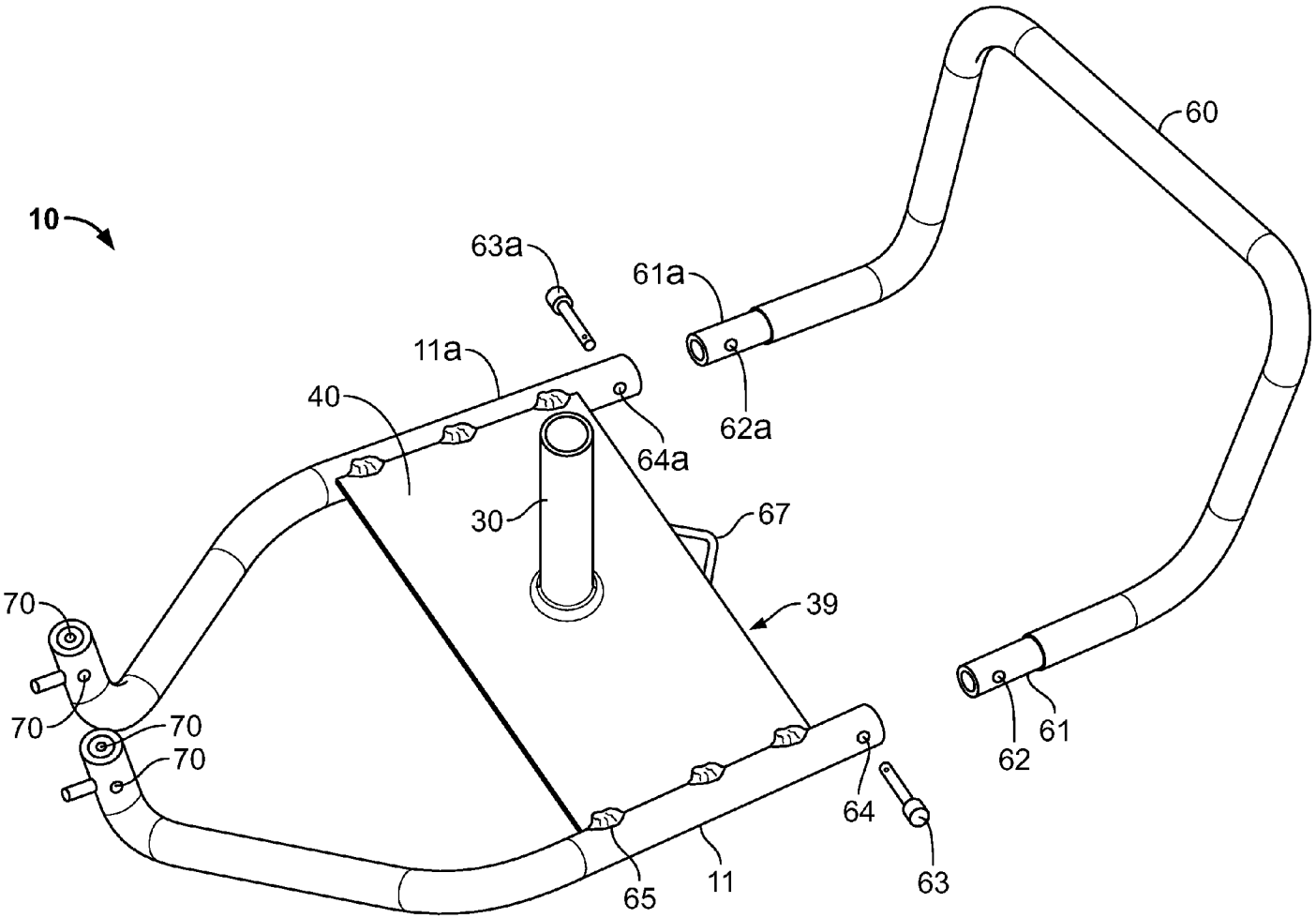
FIG. 1 shows a top perspective view of an exercise frame according to a first embodiment of the invention having a first pair of bends in the frame, and a push bar accessory.

Embodiments of the invention will now be described with reference to the accompanying figures. For simplicity and clarity of illustration, where considered appropriate, reference numerals may be repeated among the figures to indicate corresponding or analogous elements. Various details of the invention are set forth herein in order to provide a thorough understanding of the embodiments described herein. However, it will be understood that various modifications of the embodiments described herein will be apparent to persons skilled in the art without departing from the purpose and scope of the invention as outlined in the claims appended hereto. It will also be understood that well-known methods, procedures and components have not been described in detail so as not to obscure the example embodiments described herein. Also, the description is not to be considered as limiting the scope of the example embodiments described herein.

Figure 2:
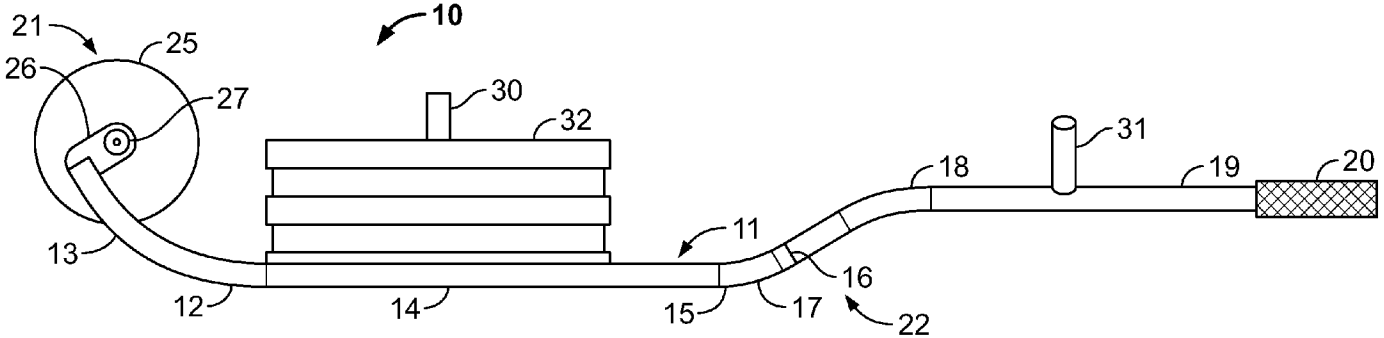
FIG. 2 shows a side elevation view of a second embodiment of the invention having first and second bends in the frame and with accessory lifter handles mounted.

According to one aspect of the invention, as shown in FIG. 1, an exercise device comprises a frame 10 having sled rails 11, 11*a*. The rails may be constructed of appropriately-sized metal tubing, (e.g. 1.5-inch diameter steel tubing). The tubing can be of any cross-section having suitable strength and slidability, for example, the tubing may be square or oval or circular in cross-section. The rails 11, 11*a* may also be constructed from "I" beams or "L" beams. First ends of the rails 11, 11*a* are provided with bends 12, 12*a*, which combine to form a wheel mounting point 62. As shown in FIG. 1, the ends 12 and 12*a* reuse the wheel mounting point 62 to be positioned at a sufficient distance from the surface on which the device rests, when the rails rest on the surface, that when a suitably sized wheel is mounted, the wheel is raised a short distance off the surface. As shown in FIG. 2, an elevated portion 13 is sufficiently short to engage a wheel, shown as 25 in FIG. 2, with the floor or ground and enable rolling movement when the frame 10 is tipped up by lifting the distal ends of rails 11, 11*a* as described below. Holes 70 are provided near the wheel ends of rails 11, 11*a* for mounting wheel 25. From the first bends 12, 12*a*, portions 14 of the rails 11, 11*a* are flat, allowing the exercise device 10 to be readily pushed when lying flat on a non-sticky surface.

Figure 4:
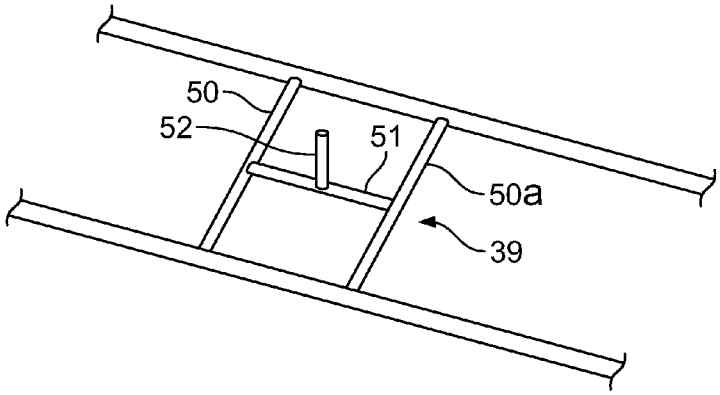
FIG. 4 shows a top perspective view of an alternative arrangement of the first weight support member of the invention.

According to one embodiment of the invention, between the portions 14 of the rails is a first weight support member 39, for example a steel plate 40, that joins the two rails 11, 11*a* and maintains the rails in a spaced relation with respect to each other. Plate 40 is fastened to both of the rails 11, 11*a* for stability, for example by spot welding, for example at weld point 65, or by bolting to the rails 11, 11*a*. A stacking rod 30 is fixed on the plate to allow a plurality of stackable weights 32 selected by the user to be rested thereon. In another embodiment, as an alternative to the metal plate shown in FIG. 1, the weight support member 39 may comprise a is a pair of spaced-apart metal bars 50, 50*a* shown in FIG. 4, which can be welded or bolted to the rails in the same manner as the plate 40. As will be understood, the bars 50 and 50*a* would function in the same manner as plate 40. In the case where a pair of metal bars 50, 50*a* is used, the two metal bars 50, 50*a* are joined by a third metal bar 51 fixed centrally between the two rails, the third metal bar 51 having a stacking member 52 similar to the stacking member 30 fixed on the metal plate 40. The bars 50, 50*a* can be formed from any metal of appropriate cost, density and strength, for example, steel.

An accessory push bar 60 is shown separated from frame 10 and in position to be fitted to it. Optionally, push bar 60 need not be one piece; it can comprise two separate bars (not shown) attachable to the ends of rails 11, 11*a*. At the attachment ends of push bar 60, reduced diameter sections 61, 61*a* are sized to fit snugly inside rails 11, 11*a* and can be secured with fastener pins 63, 63*a* through holes 62 and 64 on one side, 62*a* and 64*a* on the other side. Alternatively, rails 11, 11*a* can be swaged to reduce their diameter in a short portion of the rails so that push bar 60 can be fitted over the ends of rails 11, 11*a*. Fastener pins 63, 63*a* can be removably held in place by known means such as retaining pins. Although this construction creates a joint in the portion of the frame that slides over the surface in push mode, for smoothly-fitting joints there is little likelihood of catching threads of a carpet or blades of grass.

FIG. 2 shows another embodiment of the exercise device 10 comprising sled rails 11, 11*a*, the latter being not visible behind rail 11. Wheel-end bends 12 and hidden 12*a* are made in both of the rails 11, 11*a* similarly to FIG. 1. Above the bends 12, a wheel mounting plate 26 can be fixed to the ends of rails 11, 11*a*, for example by welding. Mounting plate 26 accepts an axle (not shown) of wheel 25 that is fastened by appropriate means, for example by bolts 27. The embodiment shown in FIG. 2 has a second pair of bends 15 and 15*a* in rails 11 and 11*a*, respectively, that reduces or eliminates the need for bends in push bar 60, as shown in FIG. 1, depending on the degree of bends at 15, 15*a*. Similarly, lifter handles 18 and 18*a* (not shown) may be straight or bent to a desired angle. Placing the second pair of bends in the rails 11, 11*a* raises joints 16, 16*a* above the surface. Lifter handles 18 and 18*a* (not shown) include a pair of secondary weight stacking rods 31. Each of which are fixed to the lifter handles 18 between the joint 16 and the handle grips 20, allowing sufficient distance from the handle grips 20 to accommodate the desired sizes of weights. Secondary weight stacking rods 31, are fixed, for example by welding, on to the lifter handles 18 and preferably in a position such that when the handles 18 are attached to the frame 10, the secondary weight stacking rods 31, 31*a* protrude generally upwards from zero to 90 degrees from the vertical with respect to the surface on which the frame 10 rests. Where the secondary weight stacking rods are off vertical, the lifter handles, which are interchangeable with each other, may be placed so that the weights are on the outside away from the centre of the exercise device to minimize possible contact with the user's knees.

Figure 3:
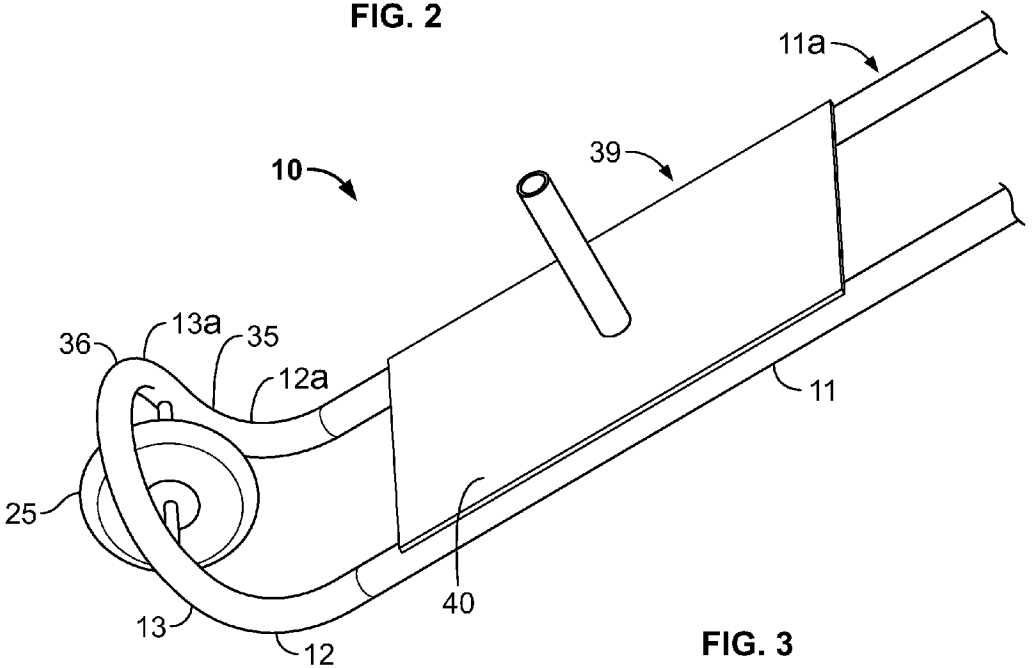
FIG. 3 shows a top perspective view of an alternative arrangement of the wheeled portion of the invention.

Other wheel may be are provided on the device; for example, wheel 25 can be mounted as in FIG. 3 at the wheel end 21 of the two rails 11, 11*a*. Above the area where the rails 11, 11*a* are bent upwards at location 12, the rail ends 13 of the rails 11 and 11*a* rise off the surface on which the exercise device 10 is situated and loin at peak 36 to form a vee section 35 in FIG. 3. Peak 36 can be a joint, having one rail with a slightly smaller cross-section at its joint end to fit inside the other rail, or the two rails can be welded or the rails can be formed from one continuous section of tubing. The two arms of the vee are sufficiently long to cause wheel 25 to be elevated off the floor or ground when the sled 10 is lying flat and to enable rolling movement when the sled 10 is tipped up by lifting the handle end 19 using the grips 20. Wheel 25 can thus be mounted between the two arms of the vee on an axle, for example having mounting plates (not shown) attached to each end, each mounting plate having holes for removably mounting to the arms of the yes and maintaining the wheel between the arms of the vee.

As used in the present specification and claims, the word "vertical" means with respect to the substantially horizontal surface on which the exercise device is normally used.

In a second embodiment as shown in FIG. 2, towards the handle end from the first mounting point, both rails 11, 11*a* have an upward handle-end bend 15 at an angle sufficient to raise the handle mounting portions 17 (and 17*a* not shown) of the two rails above the surface on which the exercise device is resting. Both the second bends and the first bends may be radiussed rather than abrupt, in order to provide for smooth operation when the exercise device 10 is pushed and the sled rail sections 14 are resting on the ground or floor of the exercise location. The rails 11, 11*a* end at handle mounting portions 17, 17*a*. To provide for operation of the exercise device 19 using the wheel 25, a pair of removable lifter handles 18 is provided, each being adapted to be removably affixed to the handle mounting portions 17 at the ends of the handle arms 16, 16*a* for lifting the exercise device in the manner of a wheelbarrow.

Figure 5:
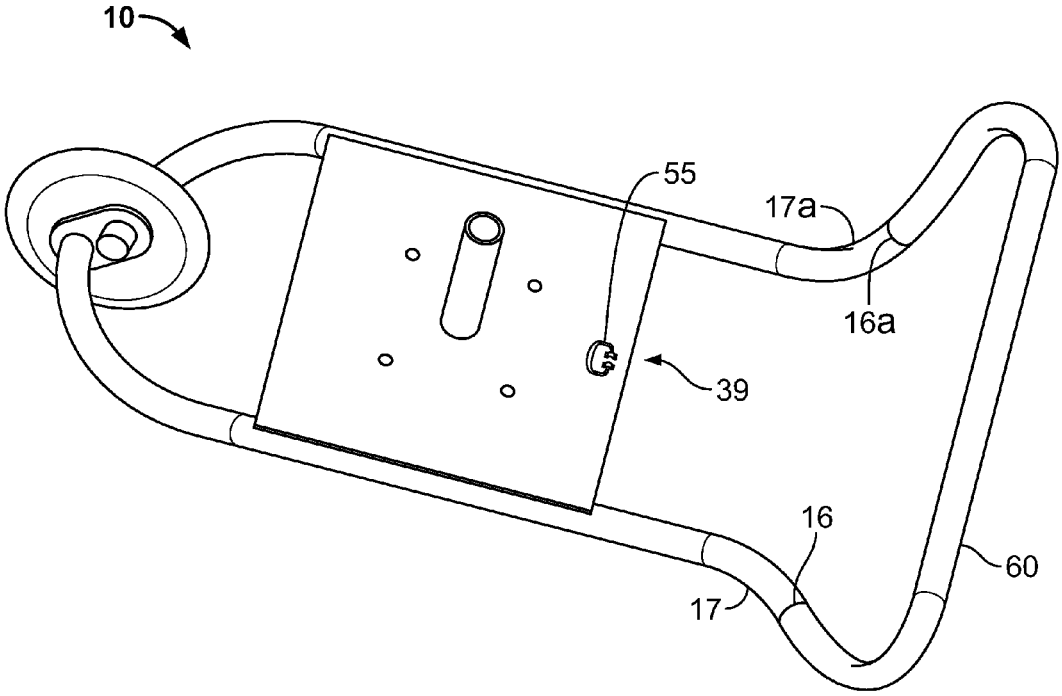
FIG. 5 shows a top perspective view of a second embodiment of the invention with a push bar mounted.

FIG. 5 shows the exercise device set up to push the frame 10 as a sled; a push bar 60 is removably affixed to the handle mounting portions 17, 17*a* as an alternative to the lifter handles 18. The lifter handles 18 or the push bar 60 in this embodiment may be inserted into the handle mounting portions 17, 17*a* at joints 16, 16*a* which are raised above the surface. The push bar 60 may be made of the same type of tubing as the rails 11, and is may be narrowed for a small distance at its two ends as described above with respect to FIG. 1. Fixing may be done by the same methods as the lifter handles 18 for convenience of the user.

For ease of pushing on the appropriate surfaces, each metal rail is optionally manufactured of a single piece from the wheel-end to the handle-end. Optionally, the wheel assembly can be made removable from the first or wheel end 21 of the frame and can be joined by conventional methods such as pins or wing nuts as mentioned above.

Figure 6:
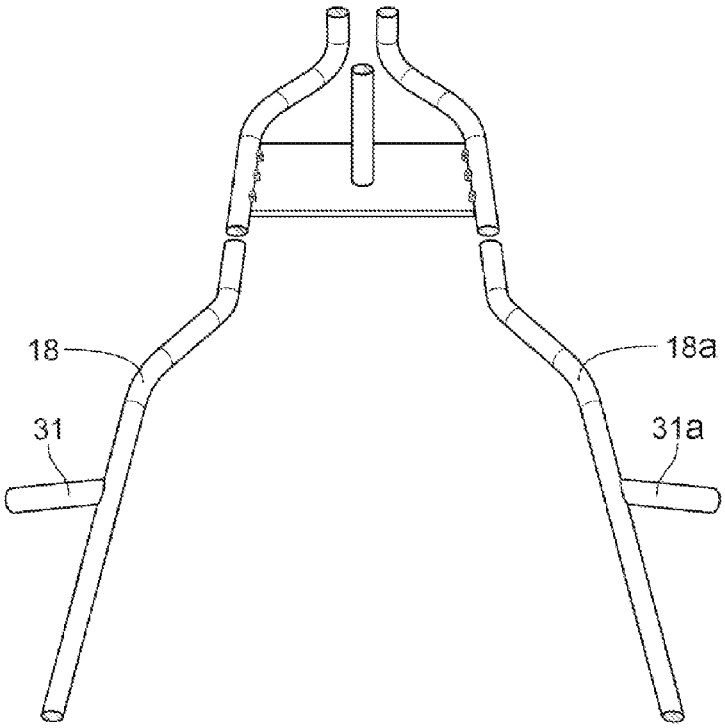
FIG. 6 shows a a top perspective view of an embodiment of the invention with secondary weight stacking rods in a position 90 degrees from the vertical.

FIG. 6 illustrates an embodiment of the invention wherein the secondary weight stacking rods 31, 31*a* are mounted at 90 degrees to the vertical. This mounting lifts the lifter handles 18, 18*a* off the ground or floor surface, which may be a more comfortable starting position for some users.

In operation, the invention can be used as a weighted sled for pushing exercises, as a wheelbarrow-style lifting and pushing platform or as a pure lifting device. In the "weight sled" configuration, the sled rails are left flat on the floor or ground surface and the desired weights are placed on the first weight stacking member. The push bar 60 is inserted into the handle mountings to provide a pair of posts against which the user can push or pull. Pads can be provided as needed to cushion the shoulder area. The device then slides on the ground-engaging sled portion of the rails, assisted by the bends in the rails 11, 11*a* that accommodate minor bumps or hollows in the ground or floor. Tow brackets 67 and 70 permit the attachment of various harnesses as desired to provide a towing exercise with weights placed on the first weight stacking rod 30. When towing towards the rear using rear tow bracket 67, the push bar is left in place to provide bends as noted above; alternatively the push bar can be left off if the frame includes handle-end bends 15, 15*a*.

In the "wheelbarrow" configuration, the lifter handles are inserted into the handle mountings to provide off-the-floor lifting points for the user to raise the handle ends 22 of the exercise device 10 sufficiently high to cause the wheel 25 to engage the floor and enable rolling. The user places the desired weights 32 onto either the first weight stacking member 30, the secondary weight stacking rods 31, 31*a* or both as needed; usually equal weights are placed on the two secondary weight stacking rods 31, 31*a*, but if the user desires, more weight can be placed on either the left or the right secondary weight stacking rod, for example if the user requires greater training effect on one arm than on the other. The user then pushes or pulls the exercise device 10 on the floor or ground. For a more intense workout, the user can choose a sloped portion of ground to move uphill, or to move downhill for exercising different muscle groups. If the user loses control of the exercise device 10, he or she can let go of the lifter handles to allow it to drop down onto the rails 11 and 11*a* and be restrained by friction with the ground.

In the "pure lifting device" configuration, the lifter handles are inserted and fixed into the handle mountings and weights are placed onto the first or secondary weight stacking rods or both as desired. The user can exercise either in the open, as in the middle of a room or field, or against a wall by moving the proximal end of the device so that the wheel bears against a wall or other difficultly movable object. The wall position allows the user somewhat greater stability than the open position.

For exercising different muscle groups, the user can substitute the lifter handles for the push bar or vice versa in the various configurations. Not only do the interchangeable lifter handles and push bar permit use for various kinds of exercises, they also aid in portability of the device, an advantage for outdoor use.

Figure 7:
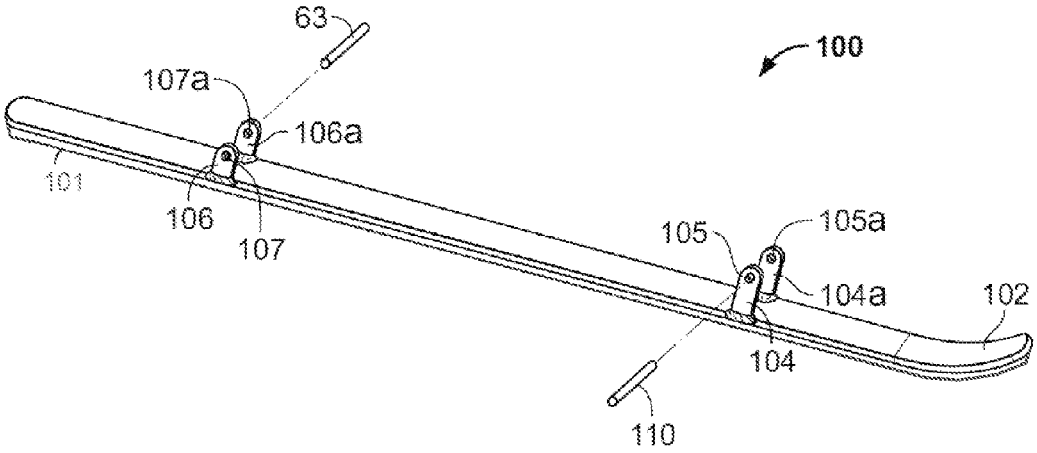
FIG. 7 shows a top perspective view of a skid according to an embodiment of the invention that can be fitted to the underside of the exercise device.
Figure 8:
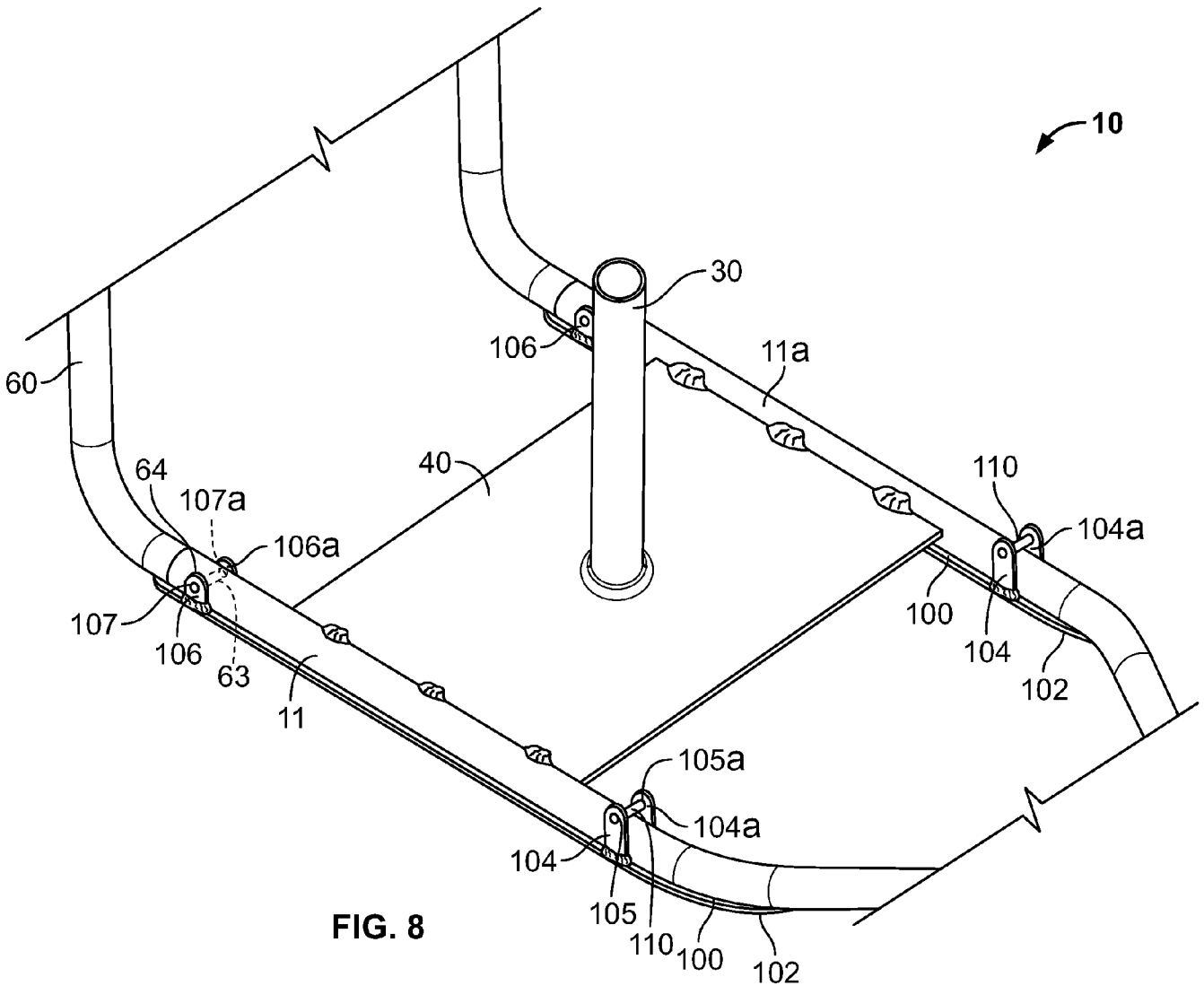
FIG. 8 shows a top perspective view of a pair of skids fitted to the exercise device.

Skids 100, as shown in FIG. 7, may be fitted to the underside of the exercise device, for example, by attaching the skids 100 to the frame 10. The skid 100 may be replaceably affixed to the exercise device. The skid 100 may be fitted with a lifted tip 102 to more easily overcome uneven surfaces. The skid 100 may equally be fitted with a lifted tip on both its ends. FIG. 8 shows one embodiment where each of the portions 14 of the rails 11, 11*a* may be fitted with a skid 100. Each skid 100 is provided with a means to connect the skid 100 to rails 11 and 11*a*. The connection means may, for example, comprise connection tabs 104, 104*a*, 106 and 106*a* may be located on each side of the skid 100. Each connection tab (104, 104*a*, 106, 106*a*) is provided with a hole (105, 105*a*, 107, 107*a*) through which a pin 110 can be inserted. Fastener pin 63 and may be inserted through holes 107 and 107*a* such that connection tabs 106 and 106*a* are located on each side of hole 64, as seen in FIG. 8. The skid 100 is positioned such that holes 107 and 107*a* are positioned above rail 11 and a pin 110 is fitted through holes 107 and 107*a*, retaining the skid 100 to rails 11. Another skid 11 is fitted to rail 11*a* using the same configuration. The skids 100 may run at least the length of plate 40. The connection means may also comprise, for example, welding, bolting, tying with wire, fastening on hinges, fastening on a leaf spring, etc. the skids 100 to the rails 11, 11*a*.

When the exercise device is utilized in a pushing or pulling mode, the skids 100 provide an intermediary between the portions 14 of rails 11, 11*a* and the surface across which the frame 10 is being moved. One advantage of using the skid 100 is that the rails 11, 11*a* are not in direct contact with the surface and hence, the frame 10 is not abrasively worn while being pushed or pulled. In particular, when the exercise device is being pushed or pulled across a hard and abrasive surface, for example, concrete, the skid 100 is worn instead of the frame 10. If the skid 100 becomes worn beyond a condition in which it may be suitably used, the skid 100 may be replaced or repaired. The skid 100 may be formed from a metal, (e.g. steel), a polymer (e.g. high density polyethylene, polytetrafluoroethylene resin, or rubber) or any material sufficiently tough to support the exercise device and allow for it to be pushed or pulled across a surface.

Furthermore, by providing a skid 100 as an intermediary between the frame 10 and the surface across which the exercise device is being moved, the frictional force resisting the exerciser may be adjusted or optimized for the surface upon which the frame 10 is being moved. The skid 100 may be optimized for a particular surface or optimized to perform a particular exercise by choosing a skid material that exhibits, for example, optimal static and kinetic friction coefficients when pushed or pulled across the surface. For example, the lubricated friction coefficient between wet grass and the skid 100 may also be taken into account. Other properties of the skid 100 may be adjusted to optimize resistance when pushing or pulling the exercise device across a surface and to mitigate damage and wear of the surface. For example, the area of the surface-engaging face of the skid 100 may be adjusted by varying the width and length of the skid 100 and in addition, the angle of the skid tip 102 may be adjusted. The surface of the skid 100 may be repaired or modified by, for example, resurfacing, painting, powder-coating, or polishing the skid 100 to adjust or renew the properties of the ground-engaging face. The skid 100 could also be provided with a replaceable surface-engaging boot 101 shown in FIG. 7 that can be applied or removed to adjust the frictional coefficient between the exercise device and the surface across which it is moved. By way of example, the boot 101 may be removable and may be fashioned from a polymer such (E.g. an elastomer), a metal, a ceramic or any other material that is sufficiently resilient to wear when moved across the surface on which the exercise device is intended to be used. The boots 101 may be fixed to a portion of the skid 100 (as shown in FIG. 7) or the entire under surface of the skid 100.

Those skilled in the art will recognise that other variations and modifications may be made to the embodiments disclosed herein without departing from the spirit of the invention as defined by the following claims. For example, the locations of tow brackets on the sled are optional, as is the type of tow harness and rope, cable or chain. A pair of spaced-apart wheels on the same axis can be used as an alternative to a single wheel for enhancing balance for the user.

The description above is intended to be illustrative rather than restrictive. Variations in the structure and operation of the exercise device of the invention are intended to form part of the invention insofar as they are within the spirit and scope of the appended claims.

I claim:

1. An exercise device comprising:

a frame comprising a pair of longitudinal support rails arranged side by side in a spaced apart arrangement, the support rails being connected to each other by a connector;

the frame having a first end and a second end, the first end adapted to accept a wheel;

the support rails including first ends proximal to the first end of the frame, the first ends of the support rails including bends, wherein the bends form a pivot point on the frame, whereby the frame is pivotable between a first position where the support rails contact a surface on which the device rests and a second position where the wheel contacts the surface;

the frame having a first weight support member positioned between the first end and second end of the frame and each of the support rails comprising a handle portion located at the second end of the frame, each handle portion comprising a respective second weight support member connected thereto, each of the first and second weight support members configured for receiving a weight.

2. The exercise device of claim 1, wherein the support rails include skids.

3. The exercise device of claim 2, wherein the skids are removably affixed to the support rails.

4. The exercise device of claim 2, wherein the skids are provided with removable surface-contacting boots.

5. The exercise device of claim 1, wherein at least one handle portion is detachable from the frame.

6. The exercise device of claim 1, wherein the first weight support member includes a weight stacking rod.

7. The exercise device of claim 1, wherein the connector comprises the weight support member.

8. The exercise device of claim 1, wherein the second end of the frame is provided at an angle with respect to a plane of the support rails.

* * * * *